US008596971B2

(12) United States Patent
Lu

(10) Patent No.: US 8,596,971 B2
(45) Date of Patent: Dec. 3, 2013

(54) FAN MODULE

(75) Inventor: Tung-Ke Lu, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 479 days.

(21) Appl. No.: 12/943,030

(22) Filed: Nov. 10, 2010

(65) Prior Publication Data

US 2012/0114499 A1 May 10, 2012

(51) Int. Cl.
*F04D 29/00* (2006.01)

(52) U.S. Cl.
USPC ..... 415/213.1; 415/220

(58) Field of Classification Search
USPC ..... 415/213.1, 214.1, 220; 361/695, 696
See application file for complete search history.

(56) References Cited

U.S. PATENT DOCUMENTS

2008/0137295 A1 6/2008 Chen
2009/0059521 A1 * 3/2009 Yin ..... 361/695

FOREIGN PATENT DOCUMENTS

TW M328174 3/2008

OTHER PUBLICATIONS

"Office Action of Taiwan Counterpart Application", issued on Jan. 10, 2013, p. 1-p. 5.

* cited by examiner

*Primary Examiner* — Edward Look
*Assistant Examiner* — Maxime Adjagbe
(74) *Attorney, Agent, or Firm* — Chun-Ming Shih

(57) ABSTRACT

A fan module including two brackets, two holders and a fan is provided. Each bracket has a first assembling portion formed thereon. The holders are mounted to the brackets and located between the two brackets. Each of the holders has two second assembling portions, and one end of each of the second assembling portions being connected with the first assembling portions correspondingly. The fan is assembled between the holders.

14 Claims, 9 Drawing Sheets

FAN MODULE

BACKGROUND OF THE INVENTION

1. Field of the Invention

The present invention relates to a fan module, and more particularly, to a fan module with low noise during operation.

2. Description of Related Art

In a conventional fan module, a fan is usually assembled to a bracket mounted on an enclosure with screws. In order to secure the fan to the bracket, at least four screws are usually inserted through four corners of the bracket and into the fan. When a worker fastens the screws, sometimes the screw holes are too close to the enclosure, which results in limited space for assembling operations, and fastening of the screws is inconvenient. In addition, as the fan module operates, vibrations generated by the rotating fan are transmitted to the bracket through the four screws. The vibrations cause mechanical parts to impact onto each other and so as to produce noises.

SUMMARY OF THE INVENTION

Accordingly, the present invention is directed to a fan module which has different configuration from the conventional fan module.

The present invention provides a fan module including two brackets, two holders and a fan. Each bracket includes a first assembling portion formed thereon. Each of the two holders mounted to the brackets and located between the brackets has two second assembling portions, and one end of each of the second assembling portions being connected with the first assembling portions correspondingly. The fan is assembled between the holders.

The present invention provides a fan module including two brackets, a plurality of holders, and a plurality of fans. At least one first assembling portion is formed on the brackets. The holders are located between the brackets, wherein at least one holder comprises a second assembling portion, the holder are mounted to the brackets by connecting one end of each of the second assembling portions with the first assembling portions correspondingly. The fans are assembled between the holders.

In one embodiment of the fan modules above, the first assembling portions are open slots, the second assembling portions are assembling shafts, and the assembling shafts are disposed in the open slots, respectively. The assembling shaft may be integrally formed with the holder.

In one embodiment of the fan modules above, the fan module further includes a connecting portion connecting the two holders.

In one embodiment of the fan modules above, each of the brackets includes a first portion and a second portion perpendicularly connected to each other, and the first assembling portion is disposed on the second portion.

In one embodiment of the fan modules above, each of the brackets includes a first portion, a second portion, and a third portion. The third portion is parallel to the first portion. The second portion is perpendicularly connected between the first portion and the third portion. The first end of each second assembling portion is perpendicular to the second end thereof. The first assembling portion is formed on the third portion, and the second end is disposed in the first assembling portion.

In one embodiment of the fan modules above, the second end of each second assembling portion is a C-shaped ring, the first assembling portion is an opening, and the C-shaped ring is alignigly disposed above the corresponding opening. The fan module further comprises two fasteners inserting through the C-shaped rings and fixing into the openings, respectively.

In view of the foregoing, as compared with the conventional fan module which has four contact points (fastening points of the four screws) to transmit vibrations, the vibrations generated by the fan module of the present invention during operation is transmitted through only a single point (where the second assembling portion engages the first assembling portion). Therefore, the noise level is significantly lowered.

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

Figure 1:
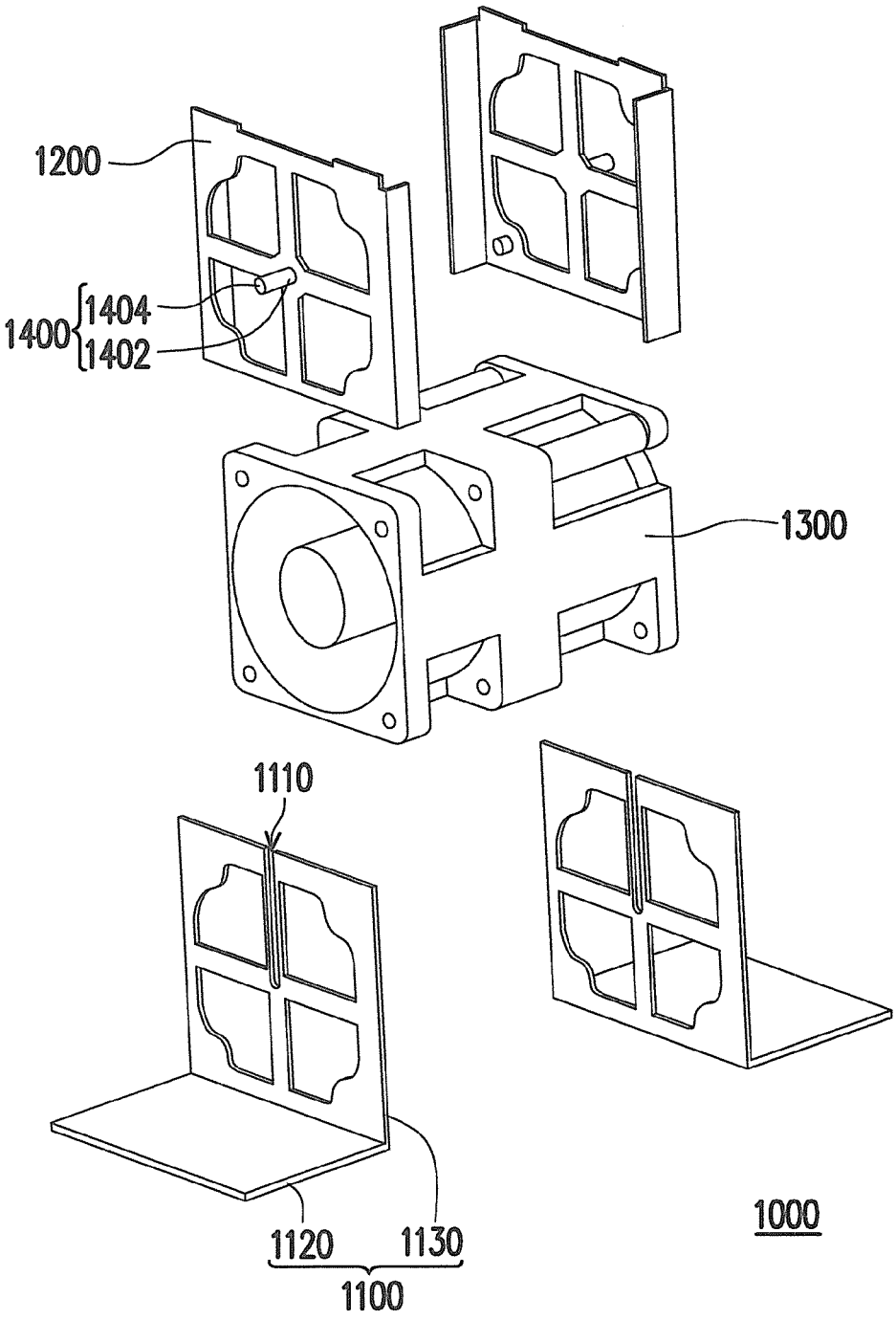
FIG. 1 is an exploded view of a fan module according to one embodiment of the present invention.

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purposes of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

The fan of the fan module of the present invention is disposed between two holders, and parts of the fan module are assembled together through the engagement between two second assembling portions disposed on the two holders and first assembling portion disposed on two brackets. The fan module improves over the assembly structure of the conventional fan module by changing the mounting manner of using four screws threaded into corners of the bracket into a single-point connection manner. This changing simplifies the assembling procedure and reduces vibration transmission as compared with the conventional fan module and, therefore, the fan module of the present invention is quieter during operation when compared with the conventional module. The single-point connection manner in which the bracket and the holders are connected is described in detail below in connection with several exemplary embodiments.

First Embodiment

Figure 2:
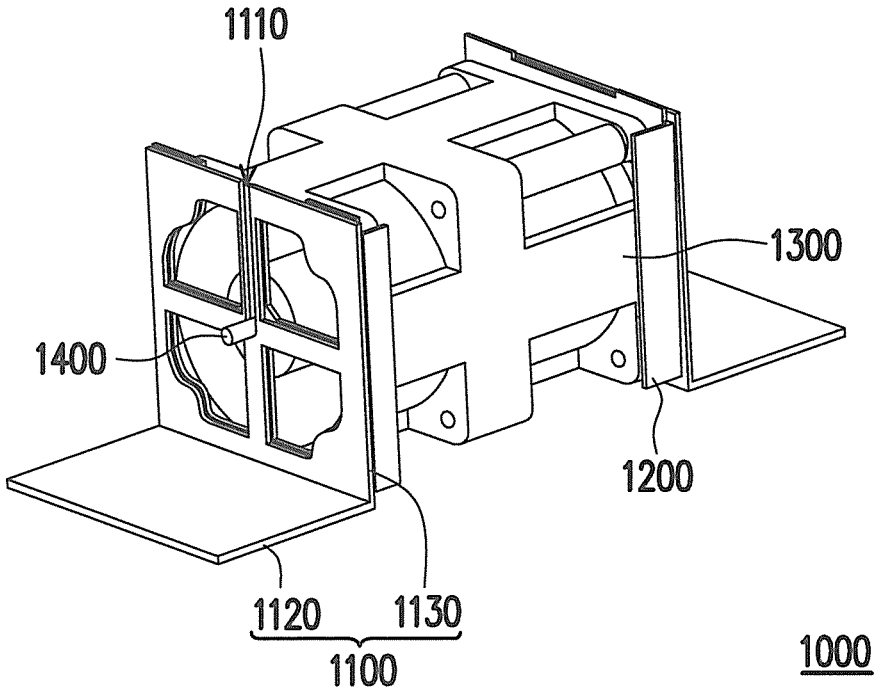
FIG. 2 is an assembled view of the fan module of FIG. 1.

FIG. 1 is an exploded view of a fan module according to one embodiment of the present invention. FIG. 2 is an assembled view of the fan module of FIG. 1.

Referring to FIG. 1 and FIG. 2, the fan module 1000 of the present embodiment includes two brackets 1100, two holders 1200, a fan 1300, and two second assembling portions 1400. Each bracket 1100 includes a first assembling portion 1110, a first portion 1120, and a second portion 1130. The first portion 1120 and the second portion 1130 are perpendicularly connected to each other, and the first assembling portion 1110 is disposed on the second portion 1130. The first portion 1120 of the bracket 1100 is adapted to be fixed within an enclosure of an electronic device (e.g. a server or computer host). The fan 1300 is disposed between the two holders 1200. A first end 1402 of each second assembling portion 1400 is connected to a corresponding one of the holders 1200, and a second end 1404 of each second assembling portion 1400 is engaged with a corresponding first assembling portion 1110, such that the holders 1200 clamping the fan 1300 are mounted between the brackets 1100 in a single-point connection manner.

Specifically, in the present embodiment, the first assembling portion 1110 is a U-shaped open slot defined through an edge of the second portion 1130. The second assembling portion 1400 is an assembling shaft that may be integrally formed with the holder 1200.

While the second assembling portion 1400 is illustrated as being integrally formed with the holder 1200 in the illustrated embodiment, it is to be understood that, in other embodiments, the holder 1200 may be mounted to the bracket 1100 by a fastener such as a screw inserted through the first assembling portion 1110 and into the holder 1200, and the first assembling portion 1110 may also be a locking hole depending upon actual requirements. The open slot or locking hole of the first assembling portion 1110, or integrally formed assembling shaft or fastener, such as, screw or rivet, are merely illustrative rather than limiting. Modifications could be made by those skilled in the art depending upon actual requirements without departing from the spirit of the present invention. In addition, in the present embodiment, the material of the brackets 1100 may be metal, and the material of the holders 1200 may be metal or plastic, depending upon actual requirements.

When assembling the fan module 1000 of the present embodiment, the fan 1300 is mounted between the two holders 1200 in any suitable manners, for example, by snap-fit, fasteners, or other suitable manners. The assembled fan 1300 and the holders 1200 are further assembled to the two brackets 1100. At this step, the assembling shaft of the second assembling portion 1400 is disposed into the open slot of the first assembling portion 1110 from the contour of the first assembling portion 1110.

From FIG. 2, it can be seen that, in the fan module 1000 of the present embodiment, vibrations generated by the fan 1300 during operation can only be transmitted via the second assembling portions 1400 to the corresponding brackets 1100 with which the respective second assembly structures 1400 contact. In the conventional fan module, the vibrations generated by the fan are completely transmitted to the brackets via screws threaded into four corners of the fan. In contrast, the vibrations generated by the fan 1300 of the present embodiment during operation are only transmitted to the brackets 1100 via a single contact point (where the assembling shaft contacts the slot), thereby achieving a quiet fan module.

Second Embodiment

This embodiment is similar to the first embodiment, and like reference numerals denote like element. Detailed description is made below only with respect to those differences between the two embodiments.

Figure 3:
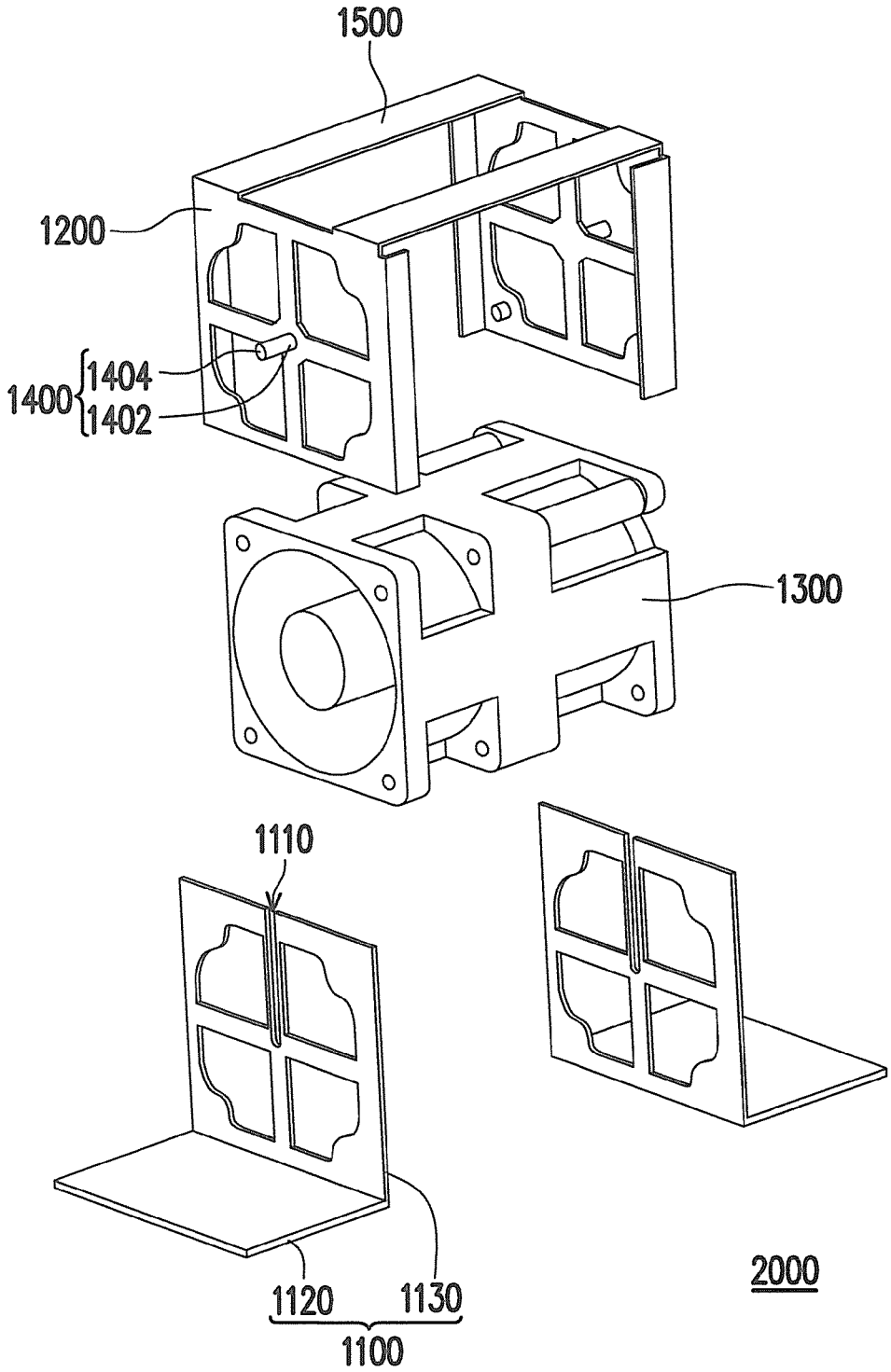
FIG. 3 is an exploded view of a fan module according to a second embodiment of the present invention.
Figure 4:
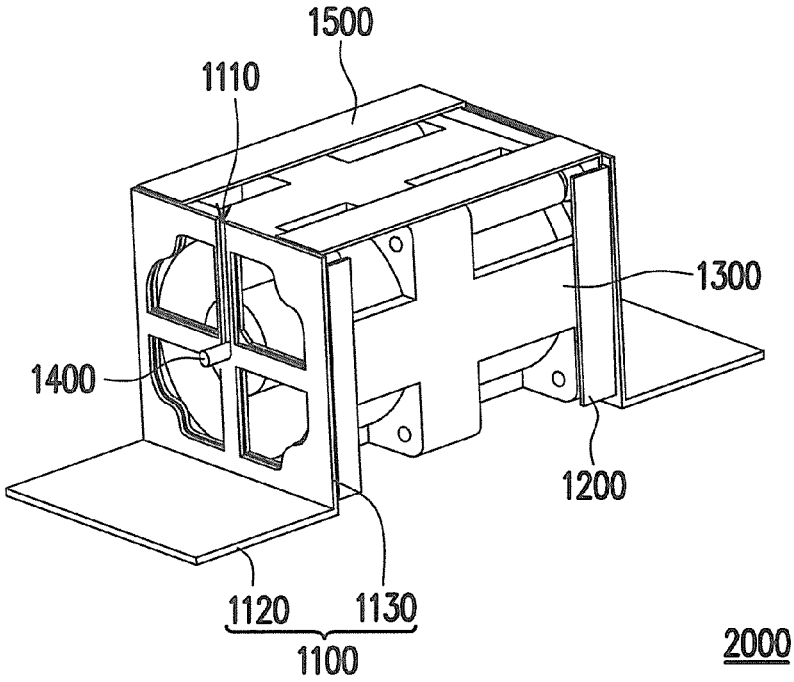
FIG. 4 is an assembled view of the fan module of FIG. 3.

FIG. 3 is an exploded view of a fan module according to a second embodiment of the present invention. FIG. 4 is an assembled view of the fan module of FIG. 3. Referring to FIG. 3 and FIG. 4, the fan module 2000 of the present embodiment further includes a connecting portion 1500. The connecting portion 1500 is connected between the two holders 1200.

To assemble the fan module 2000 of the present embodiment, the two holders 1200 may be manipulated such that free ends of the holders 1200 are disposed away from each other. As the connecting portion 1500 is compressed to bend slightly, the free ends of the two holders 1200 are driven to move away from each other. The fan 1300 is then disposed between the holders 1200. One of the fan 1300 and the holders 1200 includes an emboss or a protruding post, and the other has an concave or opening in positional correspondence with the emboss or protruding post, such that the emboss or protruding post can correspondingly fit into the concave or opening to position the fan 1300 and the holders 1200 with each other.

The second assembling portions of the holders 1200 supporting the fan 1300 therebetween are then slid into the U-shaped slots of the first assembling portions 1110 of the second portions 1130 of the brackets 1100, respectively, thereby completing the assembly of the fan module 2000 as shown in FIG. 4.

In comparison with the conventional fan module in which the holder and fan are fastened with screws and the bracket is then fastened to the holder supporting the fan with screws extending through four corners of the bracket, assembling procedure of the fan module 2000 of the present embodiment is simplified. In addition, screws are not required, thus facilitating the assembling procedure of the fan module.

In addition, the connecting portion 1500 may be hollow-carved to increase elasticity of the connecting portion 1500 while reducing the overall weight of the connecting portion 1500.

Figure 5:
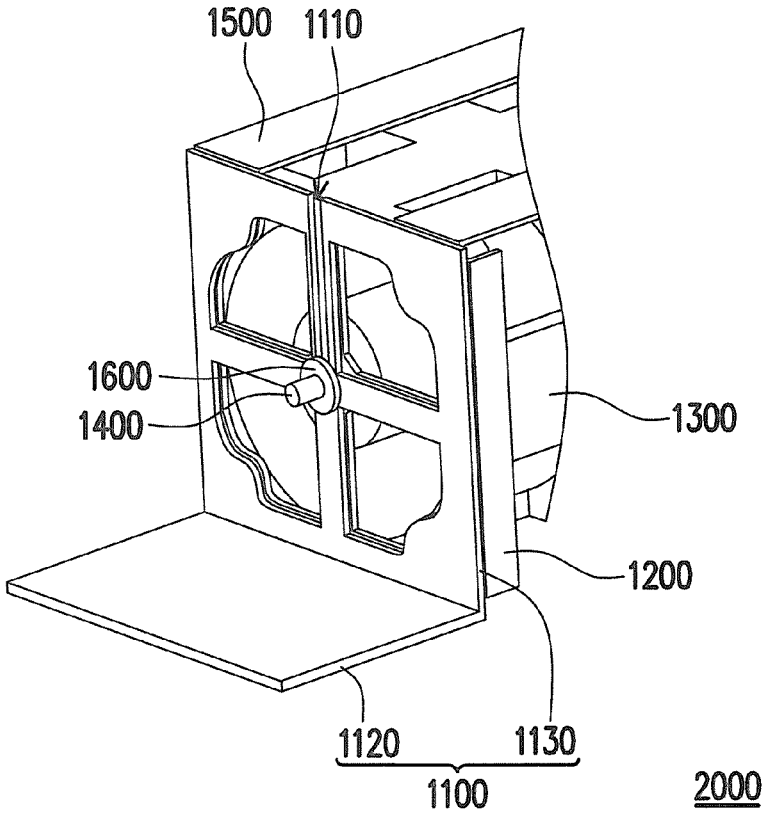
FIG. 5 is an assembled view of the fan module of FIG. 4 with a damper.

Furthermore, the fan module 2000 may include two dampers 1600 disposed in the first assembling portions 1110, respectively. Each second assembling portion 1400 is disposed in a corresponding one of the second assembling portions 1400, as shown in FIG. 5. In assembly, the dampers 1600 may be attached around the assembling shafts of the second assembling portions 1400, respectively, and then the second assembling portions 1400 are slid into the slots of the first assembling portions 1100.

It is noted that the dampers 1600 mentioned in the present embodiment may be equally employed in various other embodiments of the present invention, depending upon actual needs. Therefore, the use of the dampers 1600 are optionally described in describing other embodiments. Thus, the use of the dampers in these embodiments is illustrative rather than limiting.

Third Embodiment

This embodiment is similar to the first and second embodiment, and like reference numerals refer to like elements. Detailed description is made below only with respect to those differences between this embodiment and the first embodiment.

Figure 6:
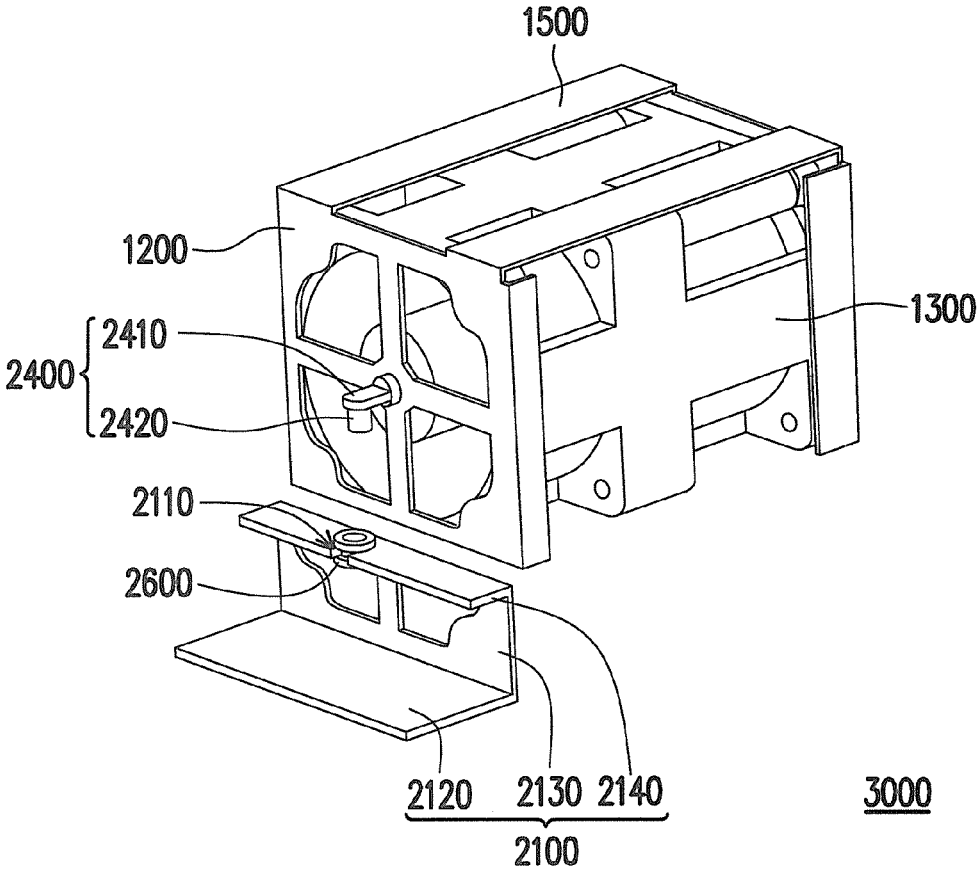
FIG. 6 is an exploded view of a fan module according to a third embodiment of the present invention.
Figure 7:
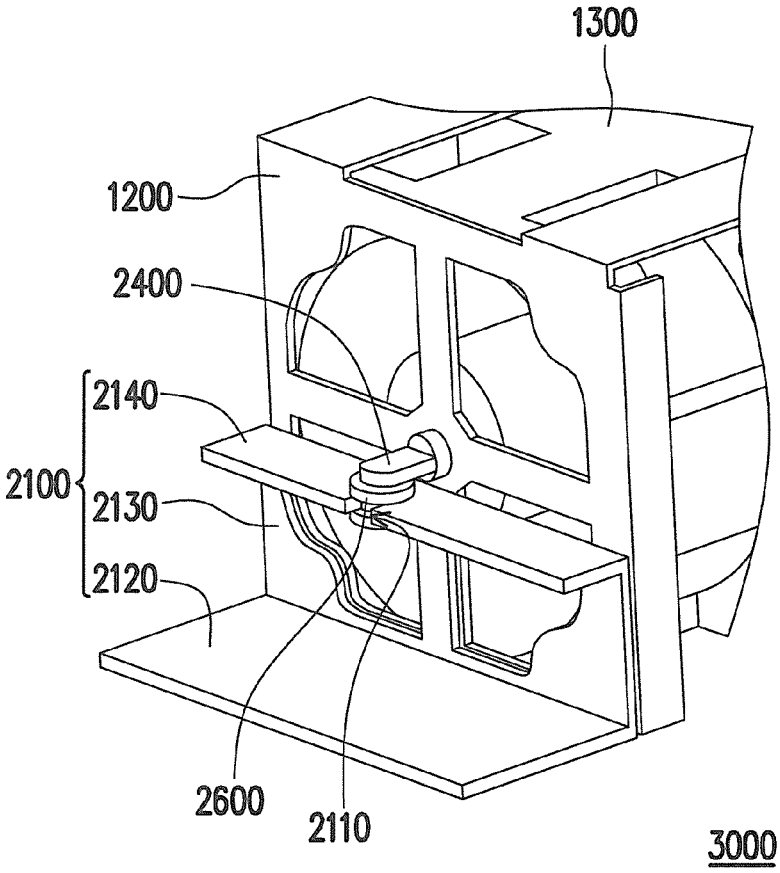
FIG. 7 is an assembled view of the fan module of FIG. 6.
Figure 8:
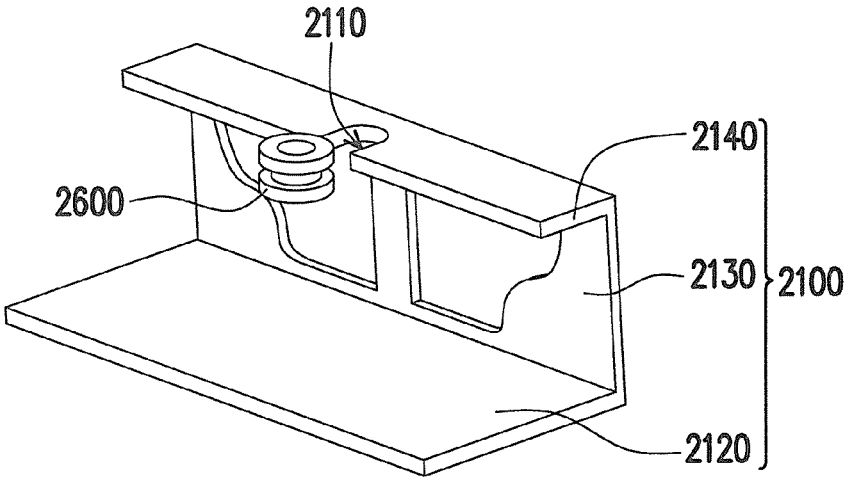
FIG. 8 is an exploded view of the bracket and the damper of FIG. 6.

FIG. 6 is an exploded view of a fan module according to a third embodiment of the present invention. FIG. 7 is an assembled view of the fan module of FIG. 6. FIG. 8 is an exploded view of the bracket and the damper of FIG. 6. Referring to FIG. 6, FIG. 7, and FIG. 8, the bracket 2100 of the fan module 3000 of the present embodiment includes a first assembling portion 2110, a first portion 2120, a second portion 2130, and a third portion 2140. The first portion 2120 and the third portion 2140 are parallel to each other, the second portion 2130 is perpendicularly connected between the first portion 2120 and the third portion 2140, and the first assembling portion 2110 is disposed on the first portion 2140. In addition, each second assembling portion 2400 includes a first end 2410 and a second end 2420 that are perpendicular to each other. In the present embodiment, the first assembling portion 2110 is an open slot, and when assembling the fan module 3000, the second end 2420 of each second assembling portion 2400 is inserted into the open slot of a corresponding one of the first assembling portions 2110.

In addition, the fan module 3000 may further include dampers 2600. The first assembling portion 2110 may be a U-shaped open slot defined through an edge of the third portion 2140, such that each damper 2600 can be easily inserted into a corresponding open slot via the open side thereof, and then the second end 2420 of each second assembling portion 2400 engages into the damper 2600 disposed in the corresponding first assembling portion 2110. The dampers 2600 can buffer the vibrations generated by the rotating fan 1300 and transmitted through the second assembling portion 2400, thus lowering the noise level.

In the present embodiment, the damper 2600 is constituted by three circular rings with the geometric centre thereof aligned vertically and the second assembling portion is inserting through the three circular rings.

Fourth Embodiment

This embodiment is similar to the above embodiments, and like reference numerals refer to like elements. Detailed description is made below only with respect to those differences between this embodiment and the above embodiments.

Figure 9:
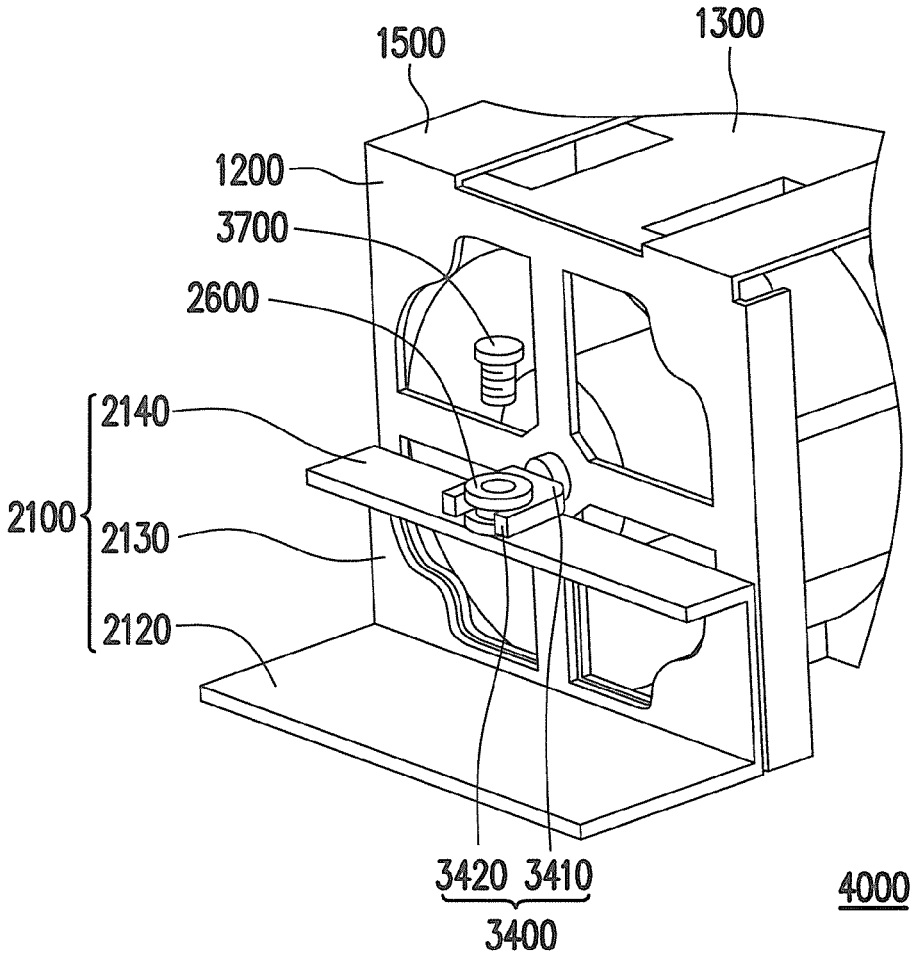
FIG. 9 is an exploded view of a fan module according to a fourth embodiment of the present invention.
Figure 10:
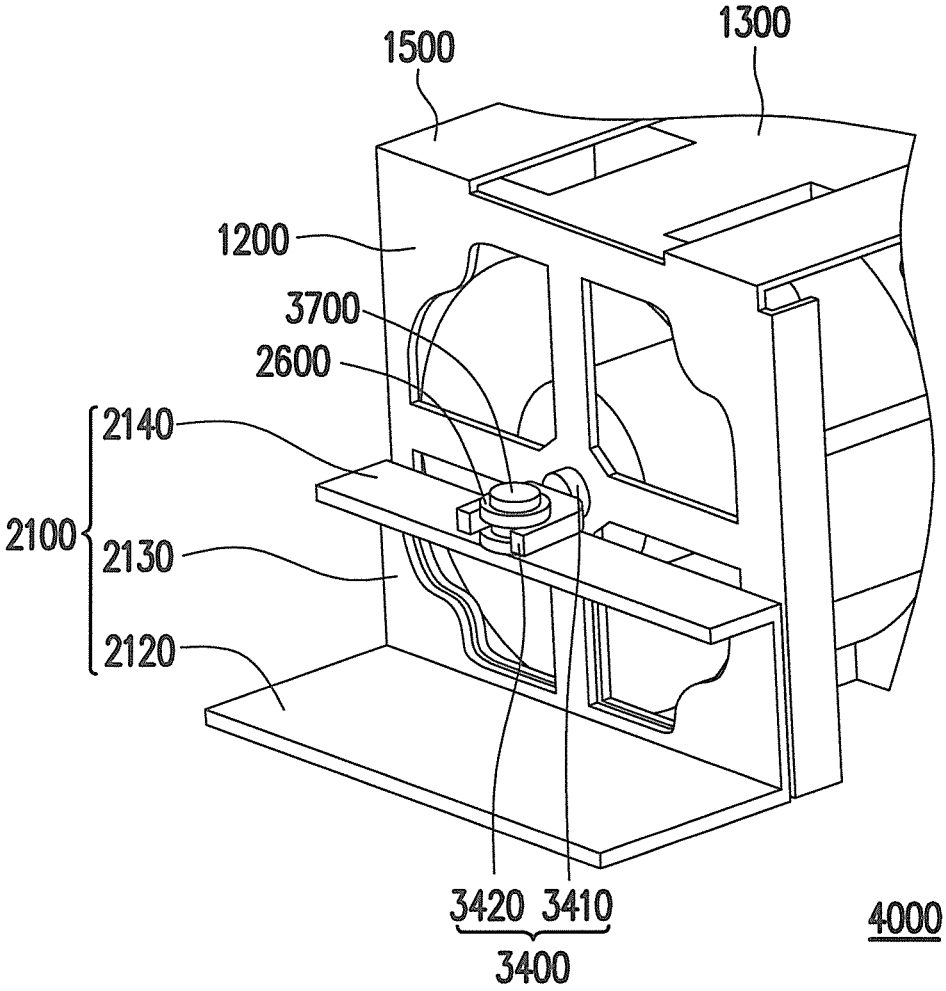
FIG. 10 is an assembled view of the fan module of FIG. 9.

FIG. 9 is an exploded view of a fan module according to a fourth embodiment of the present invention. FIG. 10 is an assembled view of the fan module of FIG. 9. Referring to FIG. 9 and FIG. 10, in the present embodiment, the second end 3420 of each second assembling portion 3400 of the fan module 4000 is a C-shaped ring. The first assembling portion (not shown in FIG. 9 and FIG. 10) is an opening. The damper 2600 is positioned above the opening and clamped by the C-shaped ring. The fan module 4000 may further include two fasteners 3700, such as, screws, bolts, rivets or other components that can provide mounting function.

The fan module may further comprise a damper 2600 disposed in one of the first assembling portions, wherein the second assembling portions are assembled with the dampers to connect with the first assembling portions, respectively. The damper 2600 is constituted by three circular rings with the geometric centre thereof aligned vertically, the three circular rings are consisting of an upper ring, a lower ring, and a middle ring with smaller radius than the upper ring and the lower ring; the second assembling portion is clamping the middle ring and suppressed by the upper ring and the lower ring.

When assembling the fan module 4000 of the present embodiment, the holders 1200 supporting the fan 1300 are placed on the third portions 2140 of the brackets 2100, with the C-shaped rings of the second ends 3420 of the second assembling portions 3400 aligned with the openings, respectively. The fasteners 3700 are inserted through the C-shaped rings, through the damper 2600, and fastened into the openings, respectively, to mount the holders 1200 and the brackets 2100 together.

While the fan module is illustrated as having one fan associated with two holders, two brackets (each having a first assembling portion) and two second assembling portions in each of foregoing embodiments, a plurality of the fan modules of the foregoing embodiments may be arranged side by side depending upon actual requirements, as described in detail below with reference to FIG. 11.

Figure 11:
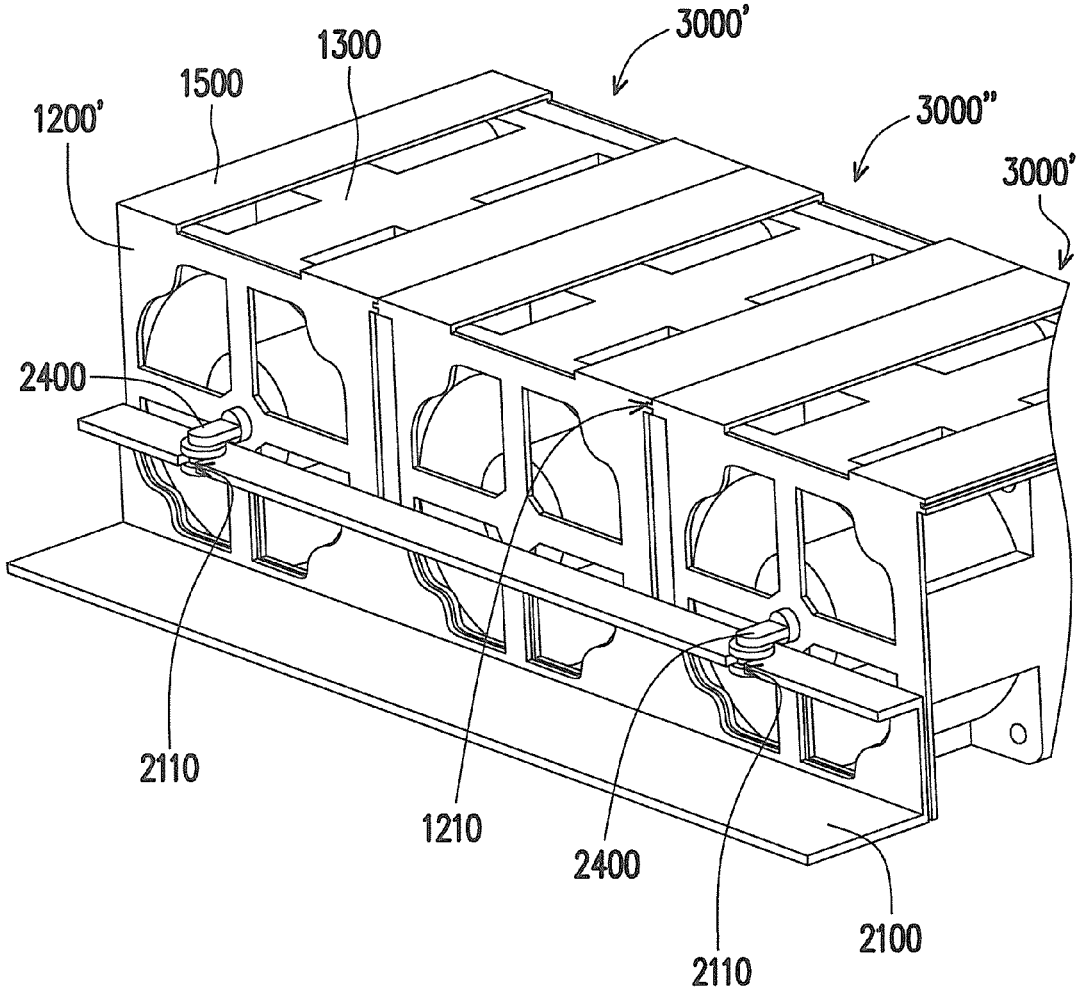
FIG. 11 illustrates multiple fan modules assembled together.

FIG. 11 illustrates multiple fan modules assembled together. Referring to FIG. 11, three fan modules 3000', 3000", 3000' are shown to be arranged side by side. The holder 1200' may further include multiple alignment structures 1210. Taking the third embodiment as an example, one side of each holder 1200' includes an alignment structure 1210 in the form of a slide slot, and the other side of each holder 1200' includes an alignment structure 1210 in the form of a tab. As the fan modules 3000', 3000", 3000' are arranged side by side, the tabs are slid into the respective slide slots such that the fan modules 3000', 3000", 3000' are positioned with respect to each other in a direction along which they are arranged. The second assembling portions 2400 of the two outmost fan modules 3000' are engaged with the first assembling portions 2110 such that the holders 1200' supporting the fans 1300 are mounted to the bracket 2100. Providing the alignment structures 1210 enables the outmost fan module 3000' to restrain and support the middle fan module 3000'. Therefore, the second assembling portion 2400 is no longer required to be formed on the holder 1200' of the middle fan module 3000', thus saving the material cost of the second assembling portion 2400.

As can be seen, when multiple fan modules are arranged together, the resulted structure is not a mere combination of these fan modules. Rather, the number of components used in the resulted structure may be modified according to requirements to reduce material cost. In addition, the alignment structures are provided to support and position the fan modules.

While the fan modules of the present embodiment are arranged together as described above, the concept of arranging multiple fan modules together can be applied to fan modules of the same or different types. For example, it is possible to arrange multiple same fan modules of one of the various embodiments described above, or arrange multiple different fan modules of different embodiments.

In summary, the fan module of the present invention at least has the following advantages:

1. Screws are not needed or the number of screws used is reduced in assembly of the fan and the holder. This reduces the difficulties in the manual assembly and saves the component cost, thereby facilitating the assembling and reducing cost.
2. The conventional fan module structure is improved by changing the four-point connection between the holder and bracket into single-point connection to reduce the number of vibration transmission paths between components. Therefore, the fan module of the present invention generates lower level of noises during operation as compared with the conventional fan module.
3. The use of damper can effectively buffer the vibration transmission, making the fan module even quieter during operation.
4. When multiple fan modules are arranged together, positioning portions are provided to support and position the fan modules, thereby reducing the number of components and effectively reducing material cost.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A fan module comprising:

two brackets, and each of the brackets comprising a first assembling portion formed thereon;

two holders mounted to the brackets, located between the brackets, and each comprising a second assembling portion, wherein a second end of each second assembling portion is a C-shaped ring, the first assembling portion is an opening, and the C-shaped ring is aligningly disposed above and connected with the corresponding opening; and a fan assembled between the holders.

2. The fan module according to claim 1, further comprising a connecting portion connecting the two holders.

3. The fan module according to claim 1, further comprising a plurality of fasteners inserting through the C-shaped rings and fixing into the openings respectively.

4. The fan module according to claim 3, further comprising a damper disposed in one of the first assembling portions, wherein the second assembling portions are assembled with the dampers to connect with the first assembling portions, respectively.

5. The fan module according to claim 4, wherein the damper is constituted by three circular rings with the geometric centre thereof aligned vertically, the three circular rings are consisting of an upper ring, a lower ring, and a middle ring with smaller radius than the upper ring and the lower ring; the second assembling portion is clamping the middle ring and suppressed by the upper ring and the lower ring.

6. The fan module according to claim 1, further comprising a damper disposed in one of the first assembling portions, wherein the second assembling portions are assembled with the dampers to connect with the first assembling portions, respectively.

7. The fan module according to claim 6, wherein the damper is constituted by three circular rings with the geometric centre thereof aligned vertically and the second assembling portion is inserted through the three circular rings.

8. A fan module comprising:

two brackets, and each of the brackets comprising a first assembling portion formed thereon;

a plurality of holders located between the brackets and mounted to the brackets; at least one of the plurality of holders comprising a second assembling portion, wherein a second end of each second assembling portion is a C-shaped ring, the first assembling portion is an opening, and the C-shaped ring is aligningly disposed above and connected with the corresponding opening; and a plurality of fans assembled between the holders.

9. The fan module according to claim 8, further comprising a connecting portion connecting the two holders.

10. The fan module according to claim 8, further comprising a plurality of fasteners inserting through the C-shaped rings and fixing into the openings respectively.

11. The fan module according to claim 10, further comprising a damper disposed in one of the first assembling portions, wherein the second assembling portions are assembled with the dampers to connect with the first assembling portions, respectively.

12. The fan module according to claim 10 wherein the damper is constituted by three circular rings with the geometric centre thereof aligned vertically, the three circular rings are consisting of an upper ring, a lower ring, and a middle ring with smaller radius than the upper ring and the lower ring; the second assembling portion is clamping the middle ring and suppressed by the upper ring and the lower ring.

13. The fan module according to claim 8, further comprising a damper disposed in one of the first assembling portions, wherein the second assembling portions are assembled with the dampers to connect with the first assembling portions, respectively.

14. The fan module according to claim 13, wherein the damper is constituted by three circular rings with the geometric centre thereof aligned vertically and the second assembling portion is inserted through the three circular rings.

* * * * *